US008532539B2

(12) United States Patent
Muramoto et al.

(10) Patent No.: US 8,532,539 B2
(45) Date of Patent: Sep. 10, 2013

(54) IMAGE FORMING APPARATUS

(75) Inventors: Hideya Muramoto, Osaka (JP); Hirohisa Endou, Osaka (JP); Eiji Nimura, Osaka (JP); Ikuo Makie, Osaka (JP); Masaki Hayashi, Osaka (JP); Yoshihiro Yamagishi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 283 days.

(21) Appl. No.: 12/729,747

(22) Filed: Mar. 23, 2010

(65) Prior Publication Data

US 2010/0272455 A1 Oct. 28, 2010

(30) Foreign Application Priority Data

Apr. 27, 2009 (JP) ..... 2009-108106

(51) Int. Cl.
*G03G 15/08* (2006.01)

(52) U.S. Cl.
USPC ..... 399/257; 399/27; 399/46

(58) Field of Classification Search
USPC ..... 399/9, 27, 38, 43, 46, 53, 66, 257, 399/313, 314, 343
See application file for complete search history.

(56) References Cited

U.S. PATENT DOCUMENTS

| | | | | |
|---|---|---|---|---|
| 5,640,230 | A * | 6/1997 | Ono et al. | 399/151 |
| 5,970,282 | A * | 10/1999 | Yanagida et al. | 399/101 |
| 6,324,354 | B1 | 11/2001 | Tode et al. | |

FOREIGN PATENT DOCUMENTS

| | | |
|---|---|---|
| JP | 2000-206770 | 7/2000 |
| JP | 2000-310909 | 11/2000 |
| JP | 2000-330379 | 11/2000 |
| JP | 2009-053582 | 3/2009 |

* cited by examiner

*Primary Examiner* — Walter L Lindsay, Jr.
*Assistant Examiner* — Benjamin Schmitt
(74) *Attorney, Agent, or Firm* — Smith, Gambrell & Russell, LLP

(57) ABSTRACT

An image forming apparatus includes: an image carrier that carries an electrostatic latent image; a development device that includes a toner carrier which is disposed opposite to the image carrier, carries and supplies toner to the image carrier, and develops the electrostatic latent image formed on a surface of the image carrier; and a control means that performs a refresh process in which toner is ejected from the toner carrier to the image carrier in a time an image is not formed, and a toner ejection pattern which is formed by ejecting a line image a plurality of times that has an acute angle to a main scan direction at predetermined intervals in a circumferential direction of the image carrier over a total width of a development region.

16 Claims, 9 Drawing Sheets

--Related Art--

--Related Art--

IMAGE FORMING APPARATUS

BACKGROUND OF THE INVENTION

This application is based on Japanese Patent Application No. 2009-108106 filed on Apr. 27, 2009, the contents of which are hereby incorporated by reference.

FIELD OF THE INVENTION

The present invention relates to an image forming apparatus that uses a photoreceptor drum and a development device, and more particularly, to an image forming apparatus that is able to perform a refresh process to refresh toner on a development roller in a time an image is not formed.

DESCRIPTION OF THE RELATED ART

In a conventional image forming apparatus, when repeating image formation, in a case where especially a print rate (a percentage of a printed area to an area (paper-sheet area) where image formation is possible. Hereinafter, the same as above) is low, because toner that flies from a development roller (toner carrier) to a photoreceptor drum (electrostatic latent image carrier) to be used for development is a little, a small amount of toner particles are refilled into a development device, so that the toner is excessively electrified and decrease in image density and fogging occurs in some cases. Especially, in a case where it is necessary to deal with from images such as a photograph and a graphic image which have a high print rate to images such as a letter and a logotype which have a low print rate, unevenness in the print rate becomes large, and decrease in the image density and fogging become likely to occur.

In such a case, by printing a pattern such as a solid image or the like that has a high document print rate, it is possible to fly a large amount of toner from a development roller to a photoreceptor drum side, consume the toner by transferring the toner onto a recording medium and alleviate the disadvantage; however, in a case where the machine is left for a long time without printing a solid pattern, the toner is not consumed and toner particles are fixed on the surface of the development roller by the influence of humidity and the like, so that the development roller does not recover in some cases.

To avoid this, conventionally, it is improved in such a way that electrification controllability of toner becomes stable by making toner surface shape, materials and external additives better; however, in the present situation, the toner is excessively electrified and it has not become possible to surely prevent the above phenomena from occurring.

To solve the above problems, various methods for forcibly consuming the toner on a development roller; in JP-A-2000-310909, for example, an image forming apparatus is disclosed, in which an average print rate is calculated from the number of paper sheets printed and print rates; in a case the average print rate becomes lower than a predetermined value, a direct-current bias and an alternating-current bias added on the direct-current bias are applied to a development roller, so that the toner on the development roller is forcibly ejected to a photoreceptor side for refreshment. Besides, in JP-A-2000-330379, an image forming apparatus is proposed, in which in a case where an average print rate becomes lower than a predetermined value, the toner on a development roller is forcibly consumed with rotation of the photoreceptor and the development roller stopped.

In the image forming apparatuses in JP-A-2000-310909 and JP-A-2000-330379, by performing a refresh process to forcibly eject the toner on the development roller to the photoreceptor side, it is possible to alleviate decrease in the image density and occurrence of fogging; however, it is necessary to eject toner equivalent to one or more turns of the development roller to forcibly consume the toner on the whole circumference of the development roller. Accordingly, there are disadvantages that the amount of unnecessary toner consumption other than consumption for the printing becomes large; and the toner ejected onto the photoreceptor easily adheres to a transfer roller, thereby causing rear-surface dirt of a recording medium.

To avoid this, in JP-A-2000-206770 and JP-A-2009-53582, methods are disclosed, in which a toner ejection pattern, a zigzag pattern, a reticulate-point pattern, a line pattern or the like other than a solid pattern is used to efficiently eject deteriorated toner.

According to JP-A-2000-206770 and JP-A-2009-53582, it is possible to efficiently consume the toner on a development roller by so-called edge enhancement in which a potential difference on an edge region of the toner ejection pattern becomes higher than that in a solid region. However, because of requirements for increase in image forming efficiency and low running cost of the apparatus in recent years, a method is desired to be developed, in which the amount of unnecessary toner consumption other than the consumption for the printing is further reduced and the rear-surface dirt of a recording medium is surely prevented by alleviating toner adhesion to a transfer roller.

SUMMARY OF THE INVENTION

The present invention has been made to deal with the above problems, and it is an object of the present invention to provide an image forming apparatus which forcibly ejects mainly excessive-electrified toner on a toner carrier to an image carrier side and effectively forces a refresh process to function without increasing the toner consumption amount compared with the conventional.

To achieve the above object, an image forming apparatus according to an aspect of the present invention includes: an image carrier that carries an electrostatic latent image; a development device that includes a toner carrier which is disposed opposite to the image carrier, carries and supplies toner to the image carrier, and develops the electrostatic latent image formed on a surface of the image carrier; and a control means that performs a refresh process in which toner is ejected from a side of the toner carrier to a side of the image carrier in a time an image is not formed, and a toner ejection pattern which is formed by ejecting a line image a plurality of times that has an acute angle to a main scan direction at predetermined intervals in a circumferential direction of the image carrier over a total width of a development region.

Still other objects of the present invention and specific advantages derived from the present invention will be more apparent from description of the embodiments described below.

DESCRIPTION OF THE PREFERRED EMBODIMENTS

Figure 1:
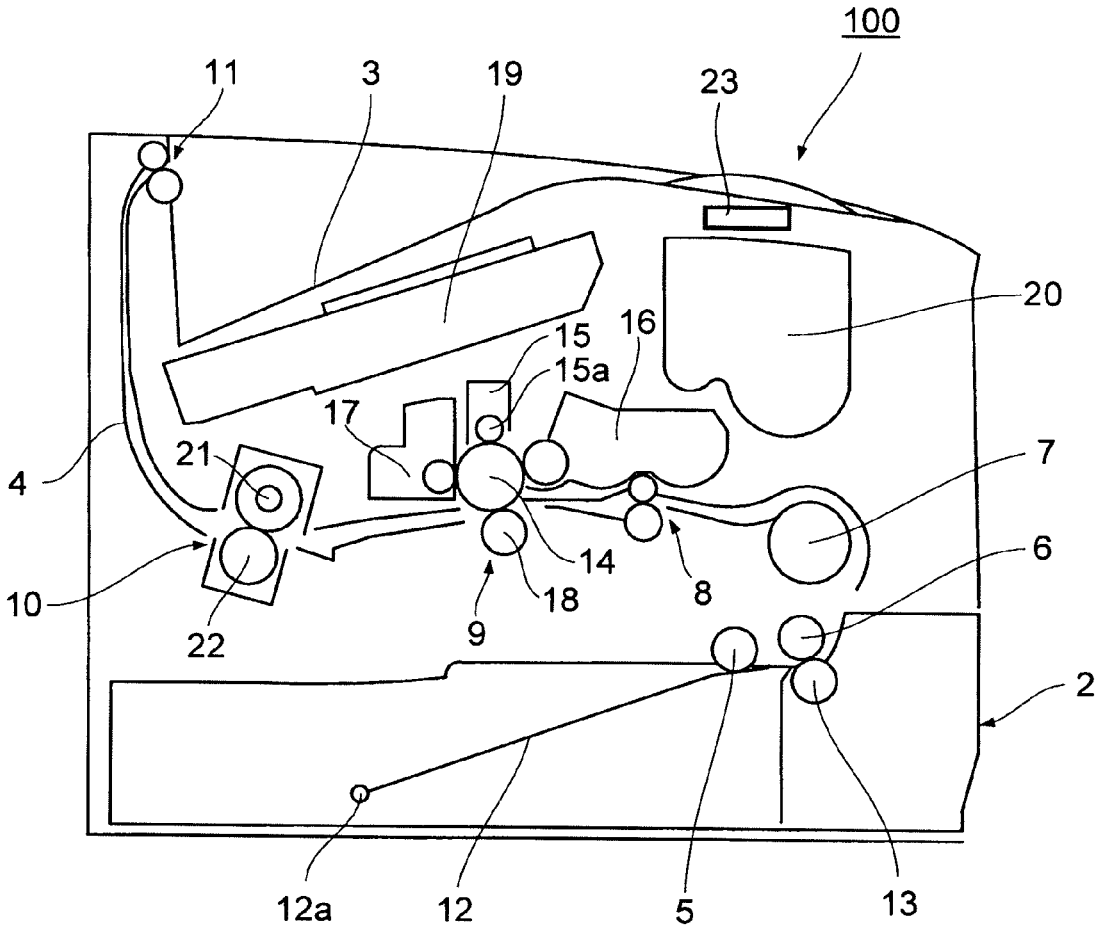
FIG. 1 is a schematic sectional view showing an overall structure of an image forming apparatus according to an embodiment of the present invention.

Hereinafter, the embodiments of the present invention are described with reference to the drawings. FIG. 1 is a schematic structural view showing a whole structure of an image forming apparatus according to an embodiment of the present invention, in which a right side is represented as a front side of the image forming apparatus. As shown in FIG. 1, in a lower portion of a main body of an image forming apparatus 100, a paper-sheet supply cassette 2 that stores paper sheets loaded is disposed. Above this paper-sheet supply cassette 2, a paper-sheet carry pathway 4 that extends substantially horizontally from the front of the main body toward the back of the main body, further extends upward to reach a paper-sheet ejection portion 3 that is formed on an upper surface of the main body; and in order from an upstream side along this paper-sheet carry pathway 4, a pick-up roller 5, a feed roller 6, an intermediate carry roller 7, a pair of resist rollers 8, an image forming portion 9, a fixing portion 10 and a pair of ejection rollers 11 are disposed.

In the paper-sheet supply cassette 2, a paper-sheet loading plate 12 that is disposed rotatably with respect to the paper-sheet supply cassette 2 by a rotation pivotal point 12*a* which is disposed at a back-end portion in the paper-sheet carry direction; and a paper sheet as a recording medium loaded on the paper-sheet loading plate 12 is pressurized to the pick-up roller 5. Besides, in a front side of the paper-sheet supply cassette 2, a retard roller 13 is disposed to come into tight contact with the feed roller 6; in a case where a plurality of paper sheets are carried by the pick-up roller 5 at the same time, the paper sheets are separated by these feed roller 6 and retard roller 13, so that only the uppermost paper sheet is carried.

And, the carry direction of the paper sheets separated by the feed roller 6 and the retard roller 13 is changed toward the back of the apparatus by the intermediate carry roller 7, so that the paper sheets are carried to the pair of resist rollers 8, adjusted in timing by the pair of resist rollers 8 and supplied to the image forming portion 9.

The image forming portion 9 forms a predetermined toner image on a paper sheet by using an electro-photographic process and is composed of: a photoreceptor drum 14 that is an image carrier which is supported rotatably clockwise in FIG. 1; an electrification device 15, a development device 16, a cleaning device 17 that are disposed around the photoreceptor drum 14; a transfer roller 18 as a transfer member that is disposed opposite to the photoreceptor drum 14 with respect to the paper-sheet carry pathway 4; and an exposure unit (LSU) 19 that is disposed above the photoreceptor drum 14. Above the development device 16, a toner container 20 that supplies toner to the development device 16 is disposed.

The electrification device 15 is equipped with an electrically conductive rubber roller 15*a* to which an electrification-bias power supply 52 (see FIG. 3) is connected; this electrically conductive rubber roller 15*a* is disposed to come into contact with the photoreceptor drum 14. And, when the photoreceptor drum 14 rotates, the electrically conductive rubber roller 15*a* comes into contact with the surface of the photoreceptor drum 14 and is driven to rotate. Here, a predetermined voltage is applied to the electrically conductive roller 15*a*, so that the surface of the photoreceptor drum 14 is evenly electrified.

Then, an electrostatic latent image based on input image data is formed on the photoreceptor drum 14 by a laser beam from the exposure unit (LSU) 19; toner is made adhere to the electrostatic latent image by the development device 16, so that a toner image is formed on the surface of the photoreceptor drum 14. And, a paper sheet is supplied from the pair of resist rollers 8 into a nip portion (transfer position) between the photoreceptor drum 14 and the transfer roller 18, so that the toner image on the photoreceptor drum 14 is transferred to the paper sheet by the transfer roller 18.

The paper sheet to which the toner image is transferred is separated from the photoreceptor drum 14 and carried to the fixing portion 10. This fixing portion 10 is disposed in a downstream side in the paper-sheet carry direction with respect to the image forming portion 9; the paper sheet to which the toner image is transferred at the image forming portion 9 is heated and pressurized by a heat roller 21 and a pressurizing roller 22 that are disposed in the fixing portion 10, so that the toner image transferred to the paper sheet is fixed.

And, the paper sheet on which the image is formed at the image forming portion 9 and the fixing portion 10 is ejected to the paper-sheet ejection portion 3 by the pair of ejection rollers 11. On the other hand, toner that remains on the surface of the photoreceptor drum 14 is removed by the cleaning device 17. And, the photoreceptor drum 14 is electrified again by the electrification device 15; and thereafter, in the same way, the image formation is performed. Besides, for the purpose of measuring an apparatus installation environment (around-machine environment), an outside-machine temperature and humidity sensor 23 is disposed over the toner container 20.

Figure 2:
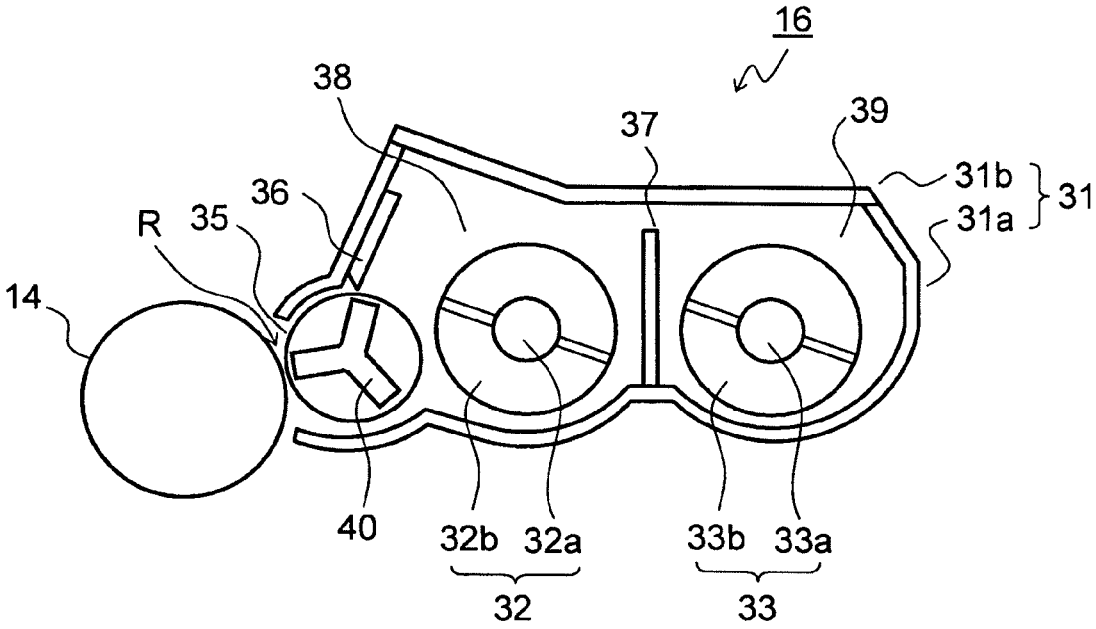
FIG. 2 is a sectional view of a development device used in an image forming apparatus according to an embodiment of the present invention.

FIG. 2 is a side sectional view of a development device incorporated in an image forming apparatus according to the embodiment of the present invention. As shown in FIG. 2, in the development device 16, a first spiral member 32, a second spiral member 33, a development roller 35 and a limit blade 36 are disposed in a housing 31 that is composed of: a casing 31*a* in which a one-component developer including magnetic toner is stored; and a cover 31*b* that closes the casing 31*a* to prevent the toner stored in the casing 31*a* from leaking to outside The inside of the casing 31*a* is divided by a partition plate 37 that extends in a longitudinal direction (direction perpendicular to paper surface in the drawing) into a first storage room 38 and a second storage room 39; the first spiral member 32 is disposed in the first storage room 38, while the second spiral member 33 is disposed in the second spiral room 39. The partition plate 37 is not disposed at both end portions in the longitudinal direction of the casing 31*a*; and this portion serves as a pathway (developer delivery portion) where toner moves between the first storage room 38 and the second storage room 39.

The first spiral member 32 and the second spiral member 33 are composed of rotation shafts 32*a*, 33*a* and spiral blades 32*b*, 33*b* that are disposed along outer surfaces of the rotation shafts 32*a*, 33*a*, respectively; and rotatably disposed in the casing 31*a* to be substantially parallel to each other. And, a structure is employed in such a way that the first spiral member 32 and the second spiral member 33 rotate in a predetermined direction, thereby circulating and carrying the toner in the first storage room 38 and the second storage room 39. Besides, to allow toner to be supplied into the casing 31*a* based on a detection result from a toner amount detection sensor (not shown), the cover 31*b* is equipped with a toner supply opening (not shown) through which toner is supplied from the container 20 (see FIG. 1).

The development roller 35 is rotatably disposed in the first storage room 38 to be substantially parallel to the first spiral member 32 and the second spiral member 33. In this development roller 35, a stationary magnet body 40 that includes a permanent magnet which has a plurality of magnetic poles (here, 3 poles); when the development roller 35 rotates following rotation of the photoreceptor drum 14, toner is made adhere (carried) to the surface of the development roller 35 by magnetic force of the stationary magnet body 40, so that a tone layer is formed. And, the toner adhering to the development roller 35 flies to the photoreceptor drum 14 and adheres to a photosensitive layer according to a potential difference between a surface potential of the photoreceptor drum 14 and a development bias applied to the development roller 35 in development region R where the development roller 35 and the photoreceptor drum 14 face each other, so that a toner image is formed on the surface of the photoreceptor drum 14.

The limit blade 36 limits the toner amount that is supplied to the photoreceptor drum 14, that is, the toner adhesion amount to the development roller 35; for example, a magnetic material such as SUS (stainless steel) or the like is used. And, the limit blade 36 is disposed so as to form a predetermined gap (0.2 to 0.3 mm) between its tip end and the development roller 35; the toner adhesion amount is limited by the distance between the limit blade 36 and the development roller 35 and a magnetic field that is generated in the gap; and a toner thin layer of dozens of micrometers is formed on the surface of the development roller 35.

Figure 3:
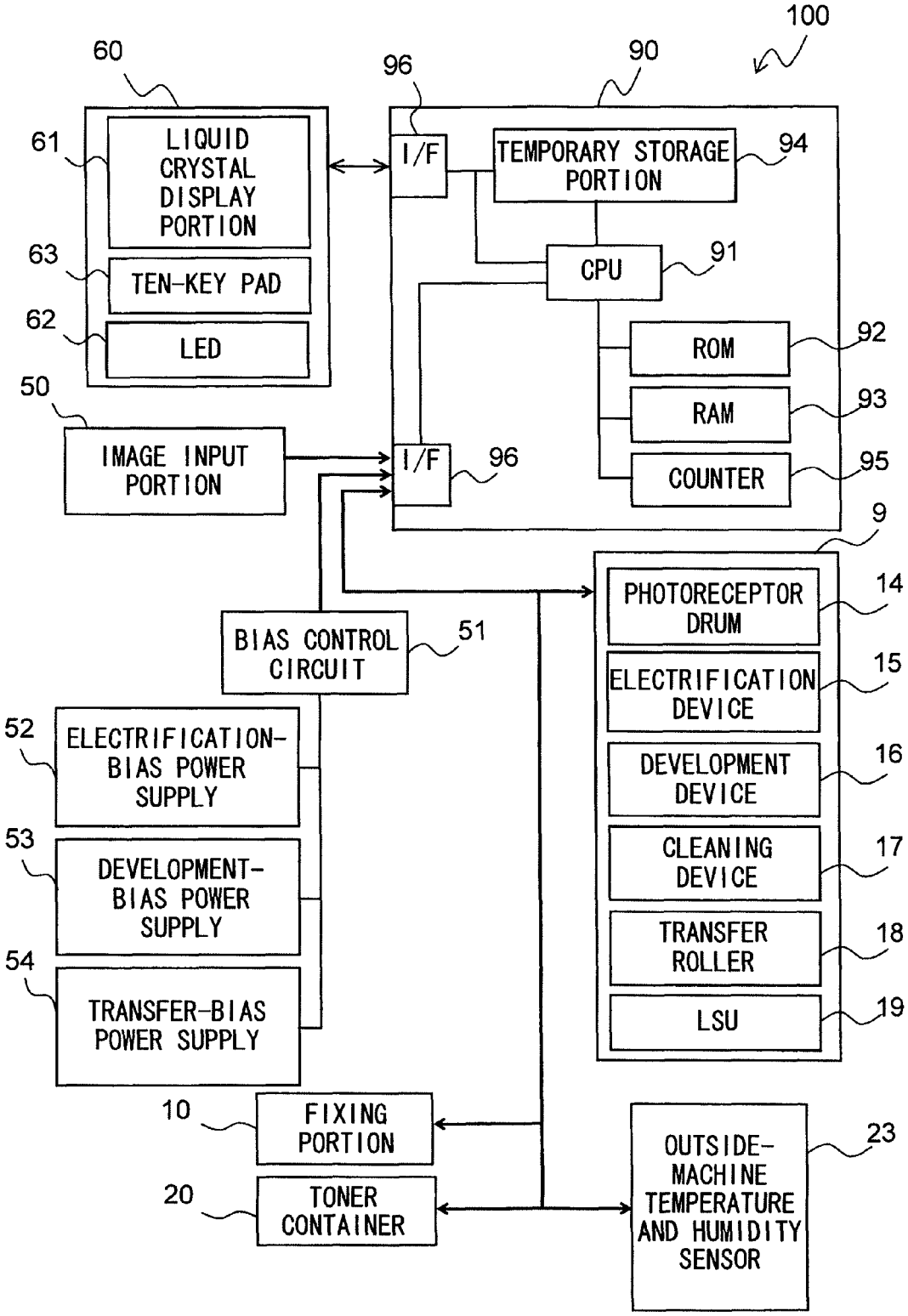
FIG. 3 is a block diagram showing a control route of an image forming apparatus according to an embodiment of the present invention.

Next, a control route of the image forming apparatus according to the present invention is described. FIG. 3 is a block diagram showing an example of a control route that is used in the image forming apparatus according to the embodiment of the present invention. Here, because various kinds of control of each portion of the apparatus are performed to use the image forming apparatus 100, the control route of the entire image forming apparatus 100 becomes complicated. Accordingly, here, description is performed focusing on portions of the control route that are necessary for practice of the present invention.

The control portion 90 includes: a CPU (Central Processing Unit) 91 as a central operation process device; a ROM (Read Only Memory) that is a storage for read only; a RAM (Random Access Memory) 93 that is a dynamically readable and writable storage; a temporary storage portion 94 that temporarily stores image data and the like; a counter 95; and a plurality (here, two) of I/Fs (interfaces) 96 that transmit control signals to each device in the image forming apparatus 100 and receive an input signal from an operation portion 60. Besides, the control portion 90 is able to be disposed in an arbitrary place in the main body of the apparatus.

The ROM 92 stores control programs for the image forming apparatus 100, numerical values and the like necessary for control, data and the like that are not changed during use of the image forming apparatus 100. The RAM 93 stores necessary data generated during control of the image forming apparatus 100, data and the like that are temporarily necessary for control of the image forming apparatus 100. Besides, the ROM 92 (or RAM 93) stores the number of paper sheets printed to determine whether it is necessary to perform a refresh process or not, a reference print rate and a rotation speed of the photoreceptor drum 14 that are used for calculation of a print length (toner ejection length) of a toner ejection pattern, and the like. The counter 95 sums up and counts the number of paper sheets printed. Here, without separately disposing the counter 95, the RAM 93, for example, may count the number of times.

Besides, the control portion 90 transmits control signals from the CPU 91 to each portion and device of the image forming apparatus 100 via the I/F 96. Besides, signals that indicate states of each portion and device and input signals are transmitted to the CPU 91 via the I/F 96. As portions and devices that the control portion 90 controls, there are, for example: the paper-sheet supply cassette 2; the fixing portion 10; the development device 16; the exposure unit 19; the toner container 20; the outside-machine temperature and humidity sensor 23; the image input portion 50; the bias control circuit 51; the operation portion 60; and the like.

In a case where the image forming apparatus 100 is a printer shown in FIG. 1, the image input portion 50 is a receiving portion that receives image data transmitted from a personal computer and the like. Besides, in a case where the image forming apparatus 100 is a copy machine, the image input portion 50 is an image reading portion that is composed of: a scan optical system that incorporates a scanner lamp which directs light to a document at a time of copy and a mirror which changes a light path of reflected light from the document; a collecting lens that collects the reflected light from the document to form an image; a CCD that converts the image-formed image light into an electrical signal; and the like. An image signal that is input from the image input portion 50 is converted into a digital signal, then, output to the temporary storage portion 94.

The bias control circuit 51 is connected to an electrification-bias power supply 52, a development-bias power supply 53 and a transfer-bias power supply 54; and operates the power supplies 52 to 54 in response to an output signal from the control portion 90. These power supplies 52 to 54 respond to control signals from the bias control circuit 51; the electrification-bias power supply 52 applies a predetermined bias to the electrically conductive rubber roller 15*a* in the electrification device 15; the development-bias power supply 53 applies a predetermined bias to the development roller 35 in the development device 16; and the transfer-bias power supply 54 applies a predetermined bias to the transfer roller 18.

The operation portion 60 is equipped with a liquid crystal display portion 61, a LED 62 that indicates various states and a ten-key pad 63; a user operates the operation portion 60 to input a command, thereby performing various kinds of setting and performing various functions such as image formation and the like. The liquid crystal display portion 61 indicates states of the image forming apparatus 100, displays image formation conditions and the number of copies printed; and as a touch panel, allows various kinds of setting such as setting of functions for both-surface print and black/white reverse and the like, magnification, density and the like. The ten-key pad 63 is used to set the number of copies printed and input a FAX number of the other end of the line in a case where the image forming apparatus 100 has also a FAX function.

Besides, the operation portion 60 is equipped with: a start button that a user uses to start image formation; a stop/clear button that is used to stop image formation and the like; a reset button that is used to bring various kinds of setting of the image forming apparatus 100 to default states and the like.

The image forming apparatus according to the embodiment of the present invention is structured in such a way that it is possible to perform the refresh process in which the toner on the development roller 35 in the development device 16 is ejected to the photoreceptor drum 14 side in a time a transfer to a recording medium is not performed, for example, a time the image forming apparatus is brought from a power-off state or a sleep mode (energy saving) to a copy start state or a time a predetermined number of prints are performed.

Figure 4:
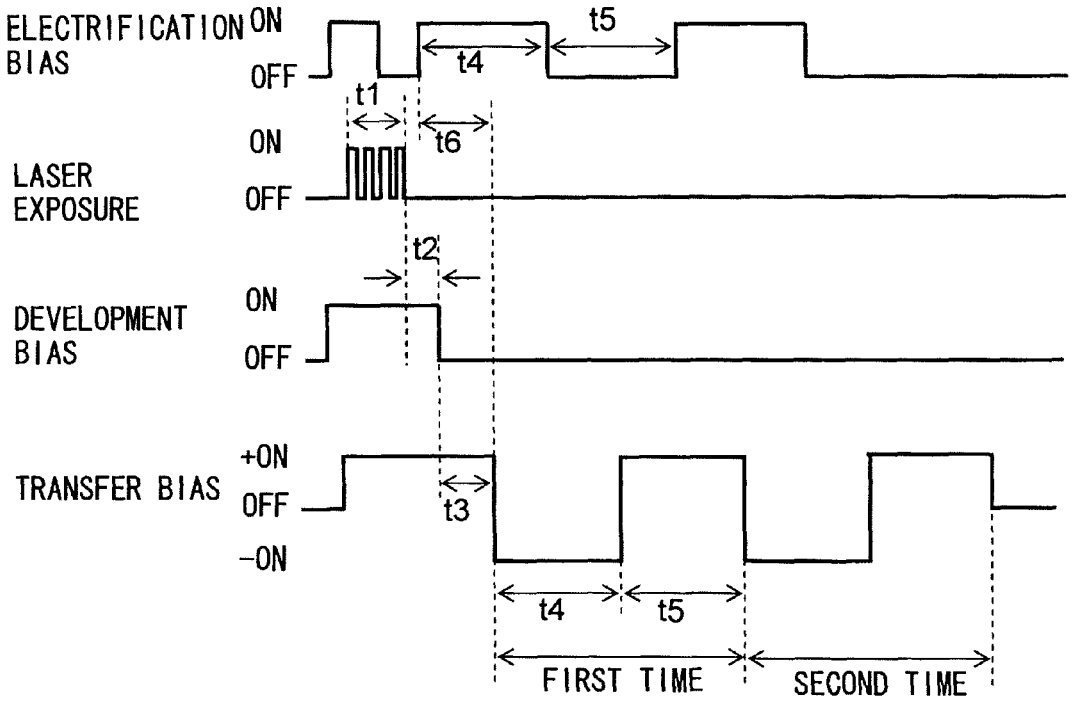
FIG. 4 is a timing chart showing an example of ON/OFF timing of an electrification bias, a laser exposure, a development bias and a transfer bias in a refresh process.
Figure 5:
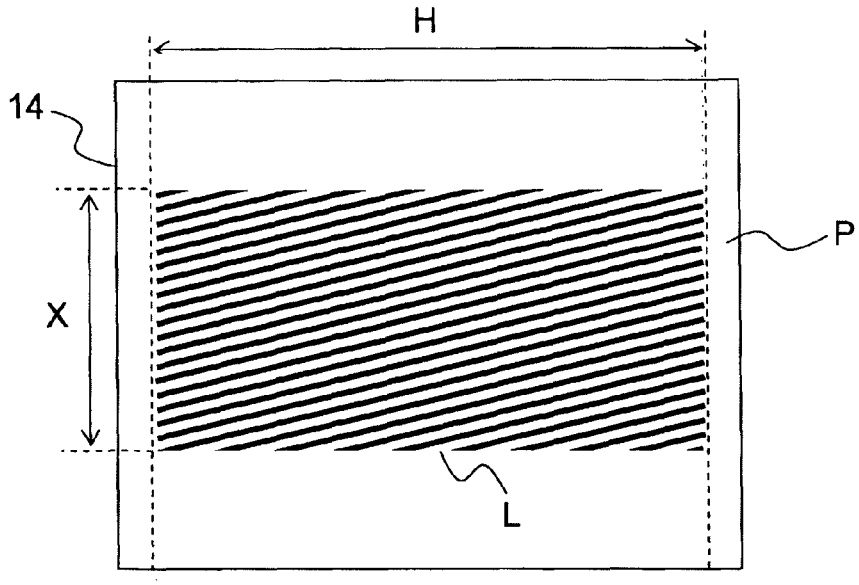
FIG. 5 is a diagram showing an example of a toner ejection pattern used in an embodiment of the present invention.

FIG. 4 is an example of a timing chart showing ON/OFF timing of an electrification bias, a laser exposure, a development bias and a transfer bias (cleaning bias) in the refresh process. FIG. 5 is a diagram showing an example of a toner ejection pattern formed on the photoreceptor drum. A performance procedure of the refresh process is described by using FIGS. 4 and 5, with reference to FIGS. 1 to 3 when necessary. Here, description is performed about a case where positive-electrified toner is used.

When performance of the refresh process is commanded, as shown in FIG. 4, an electrification bias applied to the electrically conductive rubber roller 15*a* of the electrification device 15 is turned on, the surface of the photoreceptor drum 14 is evenly positively electrified. At the same time, a development bias that has a polarity (positive) identical to that of the toner and is applied to the development roller 35 is also turned on. Then, laser exposure by the exposure unit 19 repeats turning on/off a predetermined times during t1 to attenuate partially the electrification of the surface of the photoreceptor drum 14.

When this laser exposure region (electrification attenuation region) comes to a position to face the development roller 35 as the photoreceptor drum 14 rotates, the toner on the development roller 35 counters the development bias and adheres to the laser exposure region. The on state of the development bias is continued until the photoreceptor drum 14 rotates by a predetermined amount and the laser exposure region completely passes the development roller 35; and turned off in a time of t2 after the electrification bias and the laser exposure are turned off. And, a toner ejection pattern P shown in FIG. 5 is formed on the photoreceptor drum 14.

FIG. 5 is a diagram showing an example of the toner ejection pattern that is used in the embodiment of the present invention, and shows a state of the photoreceptor drum 14 that is expanded in a plane. The toner ejection pattern P is obtained by repeating development of a line image L, which has a predetermined angle to a main scan direction (the right-to-left direction in the drawing), at predetermined intervals over a width H of a development region of the development roller 35 (see FIG. 2); and the continuation time t1 of the laser exposure in FIG. 4 is decided on by an ejection length X in a drum circumference direction (subscan direction) of the toner ejection pattern P. A method for deciding on the ejection length X is described later.

In a case where the toner ejection pattern is composed of many line images, it is known that an adhesion amount of deteriorated toner to the photoreceptor drum 14 increases compared with a solid image. This is because force to attract toner becomes strong because of edge enhancement, so that it becomes possible to efficiently move the electrified toner from the development roller 35 to the photoreceptor drum 14.

Besides, in a relationship between a line width of the line image that constitutes the toner ejection pattern and a particle diameter of the toner that adheres to the drum surface, the narrower the line width becomes, the smaller the toner particle diameter becomes. This is because the narrower the line width becomes, the higher the percentage of an edge region that occupies the toner ejection pattern, so that small-diameter toner that is present on the outermost surface of the development roller 35 and has a large amount of electrification becomes to be easily developed onto the edge region that has a large potential difference. Accordingly, it is possible to raise the refresh effect by ejecting mainly the small-diameter toner, which is electrified and adversely affects the development quality, to the photoreceptor drum 14 side.

Figure 6:
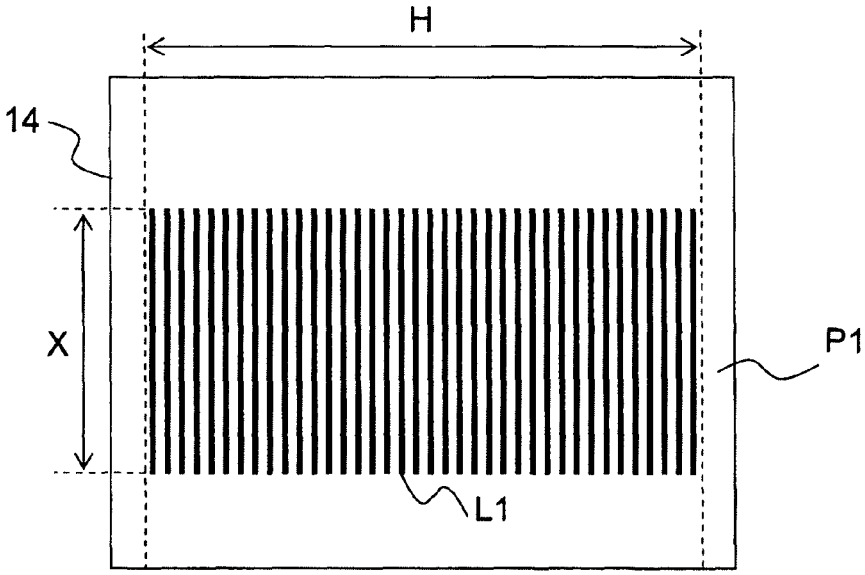
FIG. 6 is a diagram showing a conventional toner ejection pattern in which a line image is perpendicular to a main scan direction.
Figure 7:
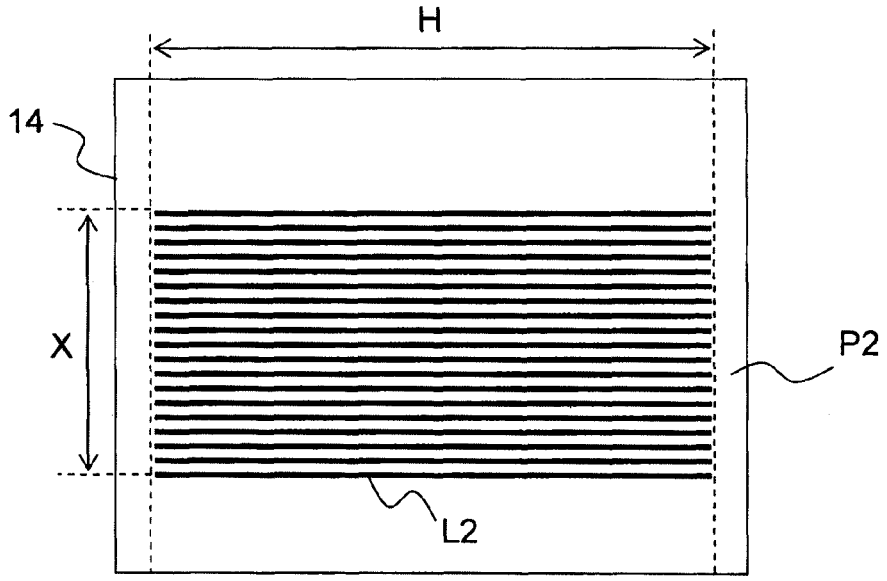
FIG. 7 is a diagram showing a conventional toner ejection pattern in which a line image is parallel to a main scan direction.

In the embodiment of the present invention, the toner ejection pattern P is composed of the slanted line image L. Here, in comparison of the toner ejection pattern P that is composed of the line image L, a toner ejection pattern P1 that is composed of a line image L1 perpendicular to the main scan direction as shown in FIG. 6, and a toner ejection pattern P2 that is composed of a line image L2 parallel to the main scan direction as shown in FIG. 7, the toner adhesion amount (toner ejection amount) per unit area in the toner ejection pattern P is large compared with the toner ejection patterns P1, P2. Although the reason for this has not been cleared yet, the following reasons are supposed.

In the toner ejection pattern P1, the toner ejection amount in the shaft direction (main scan direction) of the development roller 35 changes from a place where the line image L1 is present to a place where the line image L1 is not present (between lines); and a region where the toner is not ejected depending on an interval of the line image L1 appears. Besides, because of the same reason, in the toner ejection pattern P2 as well, the toner ejection amount in the circumferential direction (subscan direction) of the development roller 35 becomes to easily change.

In contrast, because the line image L that constitutes the toner ejection pattern P has an angle to the main scan direction, the toner ejection amount becomes unlikely to change in both of the shaft direction and the circumferential direction of the development roller 35. Accordingly, it is possible to eject more evenly the toner on the development roller 35 for the toner ejection pattern P compared with the toner ejection patterns P1, P2; and even for the same-area pattern represented by X×H, it is thought that the toner adhesion amount per unit area becomes large. Besides, difference in states of the electrostatic latent image potential due to the inclination of the line image and influence of the development system are also supposed.

Here, to refresh the whole circumference of the development roller 35, it is necessary that the length X in the drum circumference direction (subscan direction) of the toner ejection pattern P is set longer than the outer circumferential length of the development roller 35. Besides, it is sufficient to suitably set the angle, line width and line interval of the line image L in accordance with the specification of the image forming apparatus; however, it is preferable to set the angle of the line image L at 10° or larger to 60° or smaller and the line width at 2 mm or smaller so as to efficiently remove excessive-electrified toner. Besides, it is sufficient to set the line interval in such a way that the toner on the development roller 35 is able to be evenly ejected.

Thereafter, the toner ejection pattern P passes through the nip portion between the photoreceptor drum 14 and the transfer roller 18 as the photoreceptor drum 14 rotates and is finally collected from the drum surface by the cleaning device 17. To prevent adhesion of the toner ejection pattern P, a transfer bias (transfer reverse bias) that has a polarity (positive) identical to that of the toner is applied to the transfer roller 18. The on state of the transfer reverse bias is continued until the photoreceptor drum 14 rotates by a predetermined amount and the toner ejection pattern P completely passes the transfer roller 18; and turned off in a time of t3 after the development bias is turned off.

Here, the because the toner ejection pattern P is pressurized to the transfer roller 18, part of the toner ejection pattern P physically adheres to the transfer roller 18 regardless of the application of the transfer reverse bias. In the toner that adheres to the transfer roller 18, not only positive-electrified toner but also reverse-electrified (negative electrified) toner are present.

Because of this, not only a cleaning bias (transfer positive bias) that has a polarity (negative) reverse to the toner is applied to the transfer roller 18 but also the electrification bias is turned on again to positive-electrify the drum surface. According to this, the reverse-electrified toner that adheres to the transfer roller 18 counters the negative cleaning bias, is attracted to the positive potential on the drum surface and moves to the photoreceptor drum 14 side. Here, the on time of the electrification bias is equal to the application time t4 of the cleaning bias that has the polarity reverse to the toner; and the on timing of the electrification bias is earlier by a time of t6 than the application timing of the cleaning bias that has the polarity reverse to the toner.

Then, not only a cleaning bias (transfer reverse bias) that has a polarity (positive) identical to that of the toner is applied to the transfer roller 18 but also the electrification bias is turned off again. According to this, this time, the positive-electrified toner that adheres to the transfer roller 18 counters the positive cleaning bias, is attracted to the drum surface (0 V) and moves to the photoreceptor drum 14 side. Here, the off time of the electrification bias is equal to the application time t5 of the cleaning bias that has the polarity identical to the toner; and the off timing of the electrification bias is earlier by a time of t6 than the application timing of the cleaning bias that has the polarity identical to the toner.

In FIG. 4, the cleaning bias that has the polarity identical to the toner and the cleaning bias that has the polarity reverse to the toner are each applied one time; and two cycles each of which includes one turning on and one turning off of the electrification bias are repeated at the same period as the cleaning bias, so that the positive-electrified toner and the reverse-electrified toner on the transfer roller 18 are removed. Here, to perform cleaning of the whole outer circumferential surface of the transfer roller 18, it is preferable that the application time (electrification bias on time) t4 of the cleaning bias that has the polarity reverse to the toner and the application time (electrification bias off time) t5 of the cleaning bias that has the polarity identical to the toner are set at times or longer each of which is required for one rotation of the transfer roller 18. Here, because the toner ejection pattern P is composed of the line image L in the present invention, it is possible to alleviate adhesion of the toner to the transfer roller 18 compared with a solid image.

Next, a method for deciding on the ejection length X of the toner ejection pattern P is described. Regardless of user's use conditions, to set the optimum toner ejection amount depending on the print rate of an image that is printed, an ejection length set table that defines the ejection length X for every print rate is used. The ejection length set table is stored in the ROM 92 (or the RAM 93).

An example of the ejection length set table is shown in a table 1. In the table 1, the average print rate is ranked into a plurality of levels (here, 5 levels), and an ejection length (mm/paper sheet) for one sheet of image is allocated to each print level. For example, when it is assumed that the number of paper sheet printed to perform the refresh process is A, the control portion 90 calculates a print rate bn for every image based on a digital signal in the temporary storage portion 94, and further calculates an accumulated print rate Σ bn that is obtained by summing up the print rates bn. And, the accumulated print rate Σ bn is divided by the number A of paper sheets printed that is counted by the counter 95, so that the average print rate B (%) for the number A of paper sheets printed is calculated. The ejection length for one sheet of image that corresponds to the calculated average print rate B is read out from the ejection length set table and multiplied by the number A of paper sheets printed for the performance of the refresh process, so that the ejection length X (mm) in a performance time of the refresh process is calculated.

TABLE 1

| Average Print Rate (%) | Ejection Length (mm/paper sheet) |
|---|---|
| $B \leqq 0.5$ | 5 |
| $0.5 < B \leqq 1.0$ | 4 |
| $1.0 < B \leqq 1.5$ | 3 |
| $1.5 < B \leqq 2.0$ | 2 |
| $2.0 < B$ | 0 |

Besides, the ejection length X may be obtained by calculation. When it is assumed that the reference print rate (threshold value of the print rate that requires the refresh) is C (%), because a print rate difference C−B between the reference print rate C and the average print rate B is an ejection amount (for consumption shortage) necessary for one sheet of image, (C−B)×A (%) that is obtained by the ejection amount for one sheet of image by the number A of paper sheets printed is a toner ejection amount W (%) that is necessary in a performance time of the refresh process. When it is assumed that the toner ejection amount (%/mm) per unit length of the tone ejection pattern P is W1, the toner ejection length X is calculated by X=W/W1. Here, it is possible to suitably set the number A of paper sheets printed and the reference print rate C (%) depending on use's use conditions, toner characteristics and measurement values from the outside-machine temperature and humidity sensor 23 and the like.

Incidentally, to raise the image density in a time of image formation, usually, the linear speed of the development roller 35 in a time of image formation is set higher than the linear speed of the photoreceptor drum 14, so that the toner amount per unit time supplied to a vicinity region (development nip portion) between the development roller 35 and the photoreceptor drum 14 is raised. Accordingly, in a case where the toner is forcibly ejected with the development roller 35 rotated at the same linear speed as the linear speed in a time of image formation, only the toner that is easily developed and present on the surface layer of the toner thin layers formed on the development roller 35 is forcibly ejected to the photoreceptor drum 14 side; and the toner on the lower layers remains on the development roller 35, so that a sufficient refresh effect is not obtained.

To avoid this, it is preferable that the rotation speed (linear speed) of the development roller 35 in a performance time of the refresh process is set lower than the speed in a time of image formation. According to such setting, the time during which the electric field between the drum and the development roller acts on the toner thin layers on the development roller 35 that passes through the development region R (see FIG. 2) becomes long; and it is possible to eject not only the toner that is easily developed and present on the surface layer of the toner thin layers formed on the development roller 35 but also the toner on the lower layers, so that it is possible to obtain a sufficient refresh effect without prolonging the performance time of the refresh process and applying a high-voltage development bias.

Figure 8:
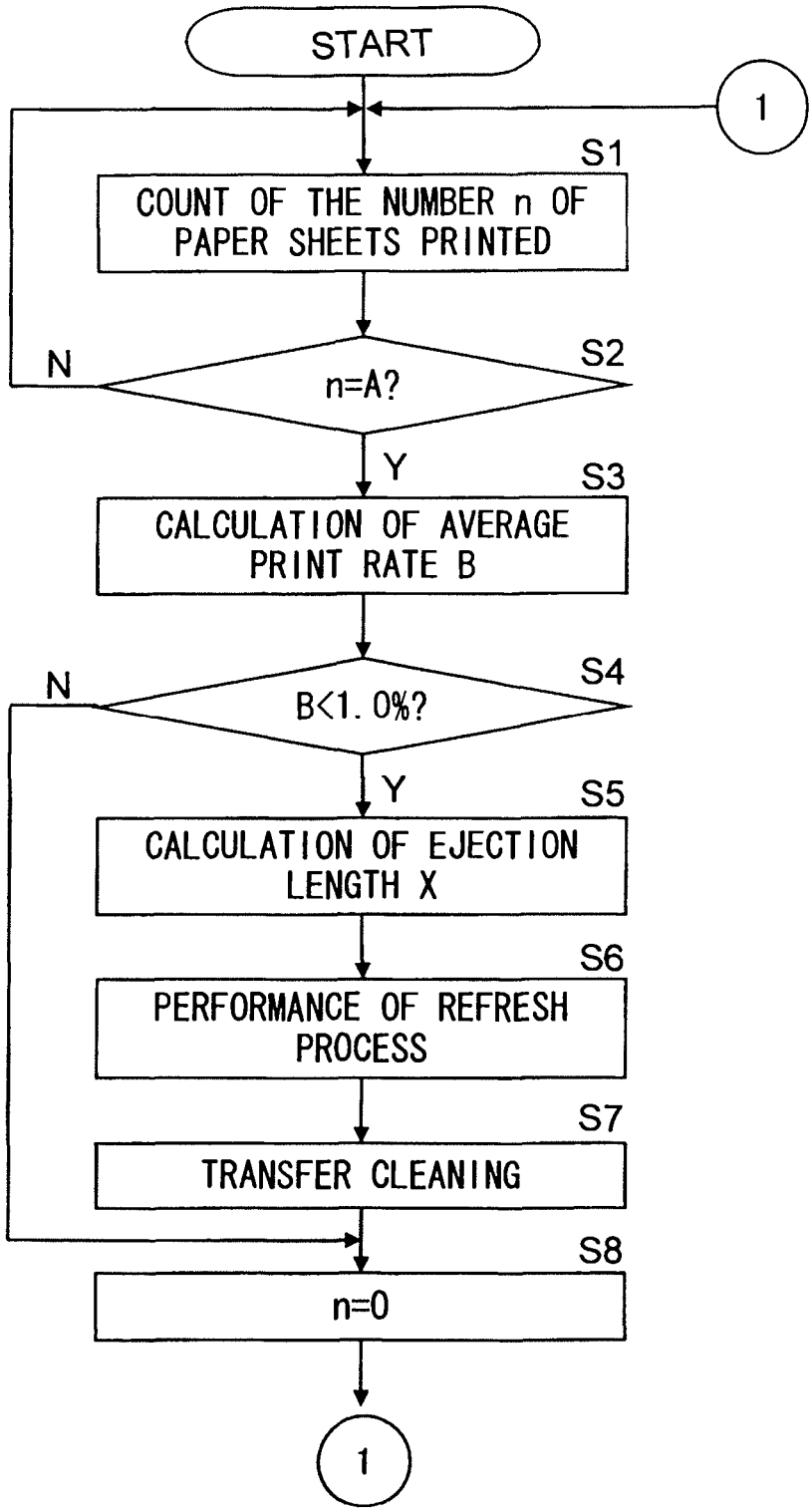
FIG. 8 is a flow chart showing a performance procedure of a refresh process in an image forming apparatus according to an embodiment of the present invention.

FIG. 8 is a flow chart showing an example of the refresh process performed in the image forming apparatus according to the embodiment of the present invention. A performance procedure of the refresh process is described by following the steps in FIG. 8, with reference to FIGS. 1 to 5 when necessary.

First, when the image formation process is started by operation of the operation portion 60 or a personal computer or the like by a user, the number n of paper sheets printed is counted by the counter 95 (the step S1). The control portion 90 calculates the print rate bn for every image based on a digital signal in the temporary storage portion 94, and further calculates the accumulated print late Σ bn that is obtained by summing up the print rates bn. Then, it is determined whether or not the number n of paper sheets printed reaches the predetermined number A of paper sheets (the step S2). When n=A, the control portion 90 calculates the average print rate B by Σ bn/A (the step S3).

Then, the control portion 90 determines whether or not the calculated average print rate B exceeds the reference print rate (here, 1.0%) (the step S4). When the average print rate B exceeds 1.0%, the toner ejection amount (C−B)×A (%) is calculated by multiplying the print rate difference C×B between the average print rate B and the reference print rate C (%), and further the ejection length X of the toner ejection pattern P is calculated (the step S5).

And, the refresh process is performed by following the timing chart in FIG. 4 to eject the toner ejection pattern P onto the photoreceptor drum 14 (the step S6). After the toner ejection is completed, a cleaning bias is applied to the transfer roller 18 to perform cleaning of the transfer roller 18 (the step S7). After the refresh process is completed, the count number n in the counter 95 is reset to 0 (the step S8), and the process returns to the step S1 again. On the other hand, the average print rate B is 1.0% or lower in the step S4, the refresh process is not performed, the count number n in the counter 95 is reset to 0 (the step S8) and the process returns to the step S1 again.

According to the above control, in the refresh process, not only the electrified small-diameter toner on the development roller 35 is efficiently removed but also the toner adhesion to the transfer roller 18 is alleviated, so that it is possible to obtain a high-convenient image forming apparatus that is able to reduce the performance time of the refresh process and alleviate unnecessary toner consumption other than the consumption for the printing operation. Besides, by use of the average print rate B of printed images, a toner, amount for consumption shortage depending on an actual print rate is calculated, and based on this, the toner ejection length X of the toner ejection pattern P is decide on, so that it is possible to set the toner ejection amount in a performance time of the refresh process at the optimum amount.

Here, in the above embodiment, the ejection length X is obtained by calculation that uses the number A of paper sheets printed, the average print rate B and the reference print rate C; however, the ejection length X may be decide on by use of the ejection length set table shown in the table 1.

Besides, the present invention is not limited to the above embodiments, and various modifications are possible without departing from the spirit of the present invention. For example, in the above embodiments, although the control portion 90 calculates the average print rate, a calculation portion that performs the calculation of the average print rate may be disposed separately from the control portion 90. Besides, of course, the present invention is applicable to not only a monochrome printer shown in FIG. 1 but also to various image forming apparatuses that include a development device such as a monochrome copy machine, a tandem-type or rotary-type color copy machine, a color printer, or a facsimile machine, a laser printer or the like.

Example 1

By use of the image forming apparatus according to the embodiment of the present invention shown in FIG. 1, a relationship between the line width of the line image that constitutes the toner ejection pattern shown in FIG. 5 and the amount and particle diameter of toner that adheres onto the photoreceptor drum is examined. As conditions of a test machine, the circumferential speed (system linear speed) of the photoreceptor drum is set at 306 mm/sec.; as for the drum surface potential, the white-portion potential (dark potential) is set at 270 V, and the image-portion potential (light potential) is set at 20 V. As for the developer, positive-electrified electromagnetic toner that has an average particle diameter of 5.0 to 9.0 μm is used.

Besides, the direct-current voltage (Vdc) applied to the development roller is set at 175 V; the Vpp, frequency and Duty of the alternating voltage (Vac) are set at 1.7 kV, 2.8 kHz and 57%, respectively.

Figure 9:
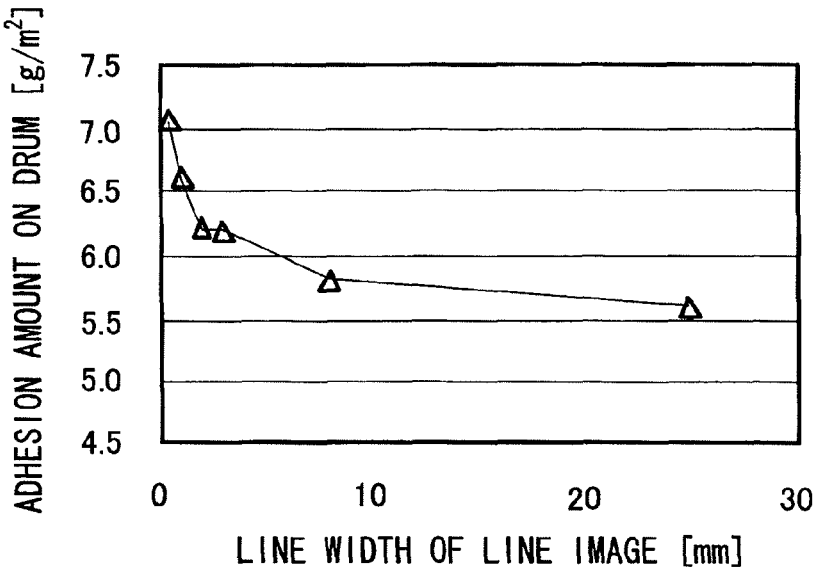
FIG. 9 is a graph showing a relationship between a line width of a line image that constitutes a toner ejection pattern and a toner adhesion amount on a drum in an image forming apparatus according to an embodiment of the present invention.
Figure 10:
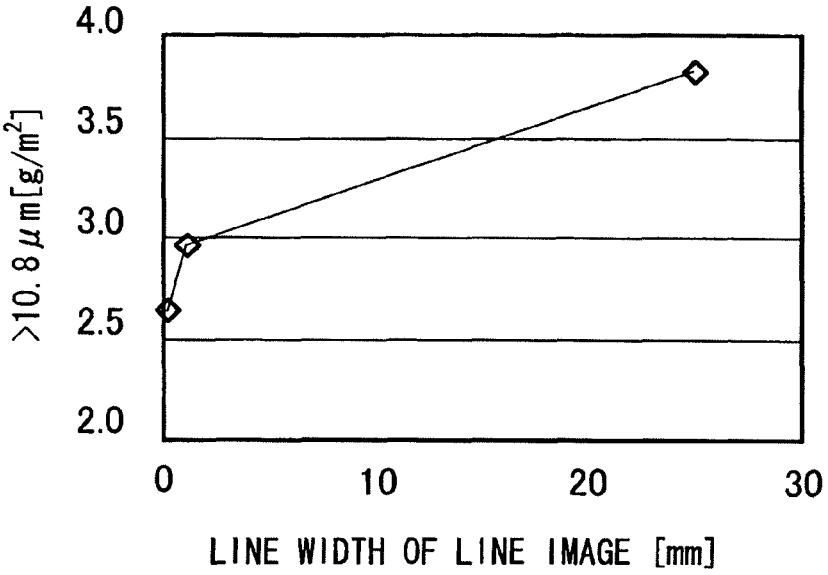
FIG. 10 is a graph showing a relationship between a line width of a line image that constitutes a toner ejection pattern and an adhesion amount of large-diameter toner on a drum in an image forming apparatus according to an embodiment of the present invention.
Figure 11:
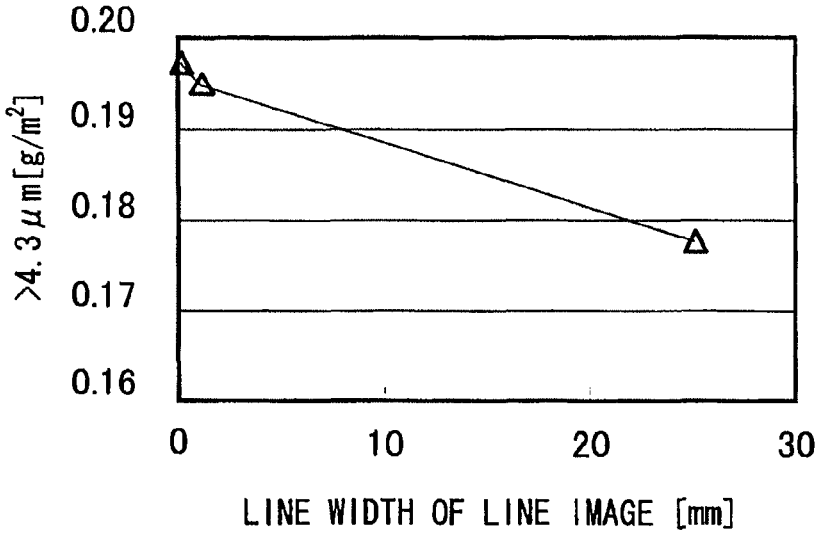
FIG. 11 is a graph showing a relationship between a line width of a line image that constitutes a toner ejection pattern and an adhesion amount of small-diameter toner on a drum in an image forming apparatus according to an embodiment of the present invention.

As apparent from FIG. 9, it is confirmed that as the line width of the line image becomes narrower, the amount of toner that adheres onto the drum increases; especially, the adhesion amount considerably increases when the line width is 2 mm or smaller. Besides, as apparent form FIGS. 10 and 11, it is confirmed that as the line width of the line image becomes narrower, the percentage of large-diameter toner (>10.8 μm) that adheres onto the drum decreases and the percentage of small-diameter toner (<4.3 μm) increases.

As the reason for this, it is thought that as the line width of the line image becomes narrower, the percentage of an edge region to a solid region becomes large, which advantageously influences the development of excessive-electrified small-diameter toner that is easily developed onto the edge region that has a large potential difference.

Example 2

A relationship between the angle of the line image that constitutes the toner ejection pattern and the amount of toner that adheres onto the photoreceptor drum is examined. The conditions of a test machine are the same as those in the example 1; a square toner ejection pattern, which includes 33 straight lines that each have a line width of 0.3 mm and a length of 25 mm and are drawn at equal intervals (about 0.5 mm) in a width of 25 mm, is rotated by a predetermined angle to the main scan direction, made adhere to the photoreceptor drum, and the toner adhesion amount per unit area is measured. The result is shown in FIG. 12.

Figure 12:
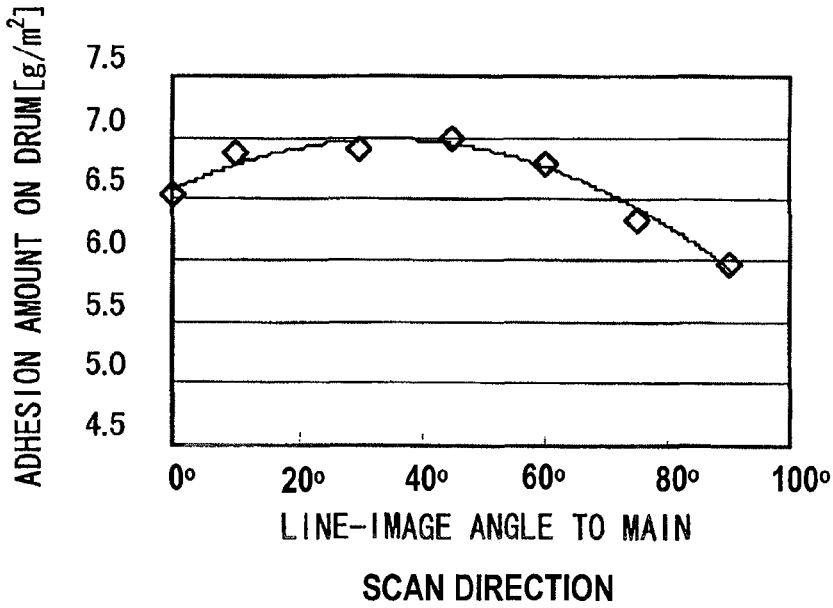
FIG. 12 is a graph showing a relationship between an angle of a line image that constitutes a toner ejection pattern to a main scan direction and a toner adhesion amount on a drum in an image forming apparatus according to an embodiment of the present invention.

As apparent from FIG. 12, as the angle of the line image that constitutes the toner ejection pattern to the main scan direction becomes larger from 0° (horizontal), the toner adhesion amount gradually increases from 6.5 g/m$^2$ and reaches 7.0 g/m$^2$ at about 45°. Besides, when the angle of the line image exceeds 45°, the toner adhesion amount gradually decreases and reaches 6.0 g/m$^2$ (the minimum value) at 90°. Besides, it is confirmed that when the angle of the line image is set at 10° or larger to 60° or smaller, the toner adhesion amount per unit area becomes 6.8 to 7.0 g/m$^2$ and it is possible to efficiently eject the toner on the development roller.

The present invention is summed up from the above embodiments as follows. Specifically, the image forming apparatus according to an embodiment of the present invention is an image forming apparatus that includes: an image carrier that carries an electrostatic latent image; a development device that includes a toner carrier which is disposed opposite to the image carrier, carries and supplies toner to the image carrier, and develops the electrostatic latent image formed on a surface of the image carrier; and a control means that performs a refresh process in which toner is ejected from the toner carrier to the image carrier in a time an image is not formed, and a toner ejection pattern which is formed by ejecting a line image a plurality of times that has an acute angle to a main scan direction at predetermined intervals in a circumferential direction of the image carrier over a total width of a development region.

According to this structure, because the toner ejection pattern is composed of the line image that is inclined to the main scan direction, unevenness of the toner ejection amount becomes unlikely to occur in both of the shaft direction and the circumferential direction of the toner carrier, so that it is possible to eject more evenly the toner on the toner carrier. Besides, because the toner ejection pattern is composed of the line image, small-diameter excessive-electrified toner is ejected efficiently by edge enhancement and the toner adhesion to the transfer member is alleviated compared with a case where the toner ejection pattern is composed of a solid image, so that it is possible to prevent rear-surface dirt of a recording medium.

Besides, in the image forming apparatus having the above structure according to an embodiment of the present invention, a line width of the line image is 2 mm or smaller.

According to this structure, because the percentage of an edge portion in the toner ejection pattern increases, it is possible to efficiently remove small-diameter excessive-electrified toner from the toner carrier by edge enhancement.

Besides, in the image forming apparatus having the above structure according to an embodiment of the present invention, an angle of the line image to the main scan direction is 10° or lager to 60° or smaller.

According to this structure, because the toner adhesion amount per unit area to the image carrier increases, it is possible to eject more efficiently the toner on the toner carrier to raise the refresh effect.

Besides, the image forming apparatus having the above structure according to an embodiment of the present invention includes a control means that controls an ejection length of the line image in a subscan direction in a performance time of the refresh process based on a print rate of an image printed.

According to this structure, because a toner amount for consumption shortage depending on an actual print rate is calculated, and a toner ejection length of the toner ejection pattern is decide on, so that it is possible to set the toner ejection amount in a performance time of the refresh process at the optimum amount.

Besides, in the image forming apparatus having the above structure according to an embodiment of the present invention, a linear speed of the toner carrier during the refresh process is made slower than a linear speed in a time an image is formed.

According to this structure, it becomes possible to eject not only the toner on the surface layer of the toner carrier but also the toner on the lower layers to the image carrier side, so that it is possible to effectively refresh the surface of the toner carrier.

Besides, the image forming apparatus having the above structure according to an embodiment of the present invention includes a transfer member that transfers the toner image on the toner carrier that is formed by the development device onto a recording medium, wherein a bias that has a polarity identical to the toner is continuously applied to the transfer member until the toner ejection pattern formed on the image carrier passes the transfer member.

According to this structure, it is possible to effectively alleviate the toner ejection pattern adhering to the transfer member when the toner ejection pattern formed on the image carrier passes the transfer member.

Besides, the image forming apparatus having the above structure according to an embodiment of the present invention includes an electrification device that electrifies a surface of the image carrier, wherein after the toner ejection pattern formed on the image carrier passes the transfer member, an electrification bias applied to the electrification device is turned on, and a bias that has a polarity reverse to the toner is applied to the transfer member, then, the electrification bias applied to the electrification device is turned off and a bias that has a polarity identical to the toner is applied to the transfer member.

According to this structure, it is possible to make positive-electrified toner and reverse-electrified toner that adhere to the transfer member during the refresh process move to the image carrier side, so that it is possible to alleviate more effectively the toner adhering to the transfer member.

Besides, in the image forming apparatus having the above structure according to an embodiment of the present invention, the bias that has the polarity reverse to the toner and is applied to the transfer member after the toner ejection pattern passes, and the bias that has the polarity identical to the toner and is applied to the transfer member after the toner ejection pattern passes are applied for a time or longer that is required for one rotation of the transfer member.

According to this structure, it is possible to surely make the positive-electrified toner and reverse-electrified toner that adhere to the whole region of the outer circumferential surface of the transfer member move to the image carrier side.

The embodiments of the present invention are applicable to image forming apparatuses that have a refresh process to refresh toner on a toner carrier in a time an image is not formed. By use of the present invention, it is possible to efficiently eject excessive-electrified toner on a toner carrier to raise a refresh effect without increasing a toner ejection amount and it is possible to alleviate rear-surface dirt of a recording medium caused by toner adhesion to a transfer member, so that it is possible to provide an image forming apparatus in which disadvantages such as density drop, fogging and the like do not occur and a high-quality image is able to be formed.

What is claimed is:

1. An image forming apparatus comprising:

an image carrier that carries an electrostatic latent image;

a development device that includes a toner carrier which is disposed opposite to the image carrier, carries and supplies toner to the image carrier, and develops the electrostatic latent image formed on a surface of the image carrier; and a control means that performs a refresh process in which toner is ejected from the toner carrier to the image carrier in a time when an image is not formed to form a toner ejection pattern which is formed by ejecting a straight line image a plurality of times at an acute angle to a main scan direction and at predetermined intervals in a circumferential direction of the image carrier over a total width of a development region, and is substantially even in toner ejection amount in the main scan direction over the total width of the development region, wherein each line image has a line width of 0.3 mm or larger to 2 mm or smaller; and a length of the toner ejection pattern in the circumferential direction of the image carrier is longer than an outer circumferential length of the toner carrier.

2. The image forming apparatus according to claim 1, wherein an angle of the line image to the main scan direction is 10° or larger to 60° or smaller.

3. The image forming apparatus according to claim 2, wherein the control means controls an ejection length of the line image in a subscan direction in a performance time of the refresh process based on a print rate of an image printed.

4. The image forming apparatus according to claim 2, wherein a linear speed of the toner carrier during the refresh process is slower than a linear speed in a time an image is formed.

5. The image forming apparatus according to claim 1, wherein the control means controls an ejection length of the line image in a subscan direction in a performance time of the refresh process based on a print rate of an image printed.

6. The image forming apparatus according to claim 5, wherein a linear speed of the toner carrier during the refresh process is slower than a linear speed in a time an image is formed.

7. The image forming apparatus according to claim 5, further comprising a transfer member that transfers a toner image on the toner carrier that is formed by the development device onto a recording medium, wherein a bias that has a polarity identical to the toner is continuously applied to the transfer member until the toner ejection pattern formed on the image carrier passes the transfer member.

8. The image forming apparatus according to claim 7, further comprising an electrification device that electrifies a surface of the image carrier, wherein after the toner ejection pattern formed on the image carrier passes the transfer member, an electrification bias applied to the electrification device is turned on, and a bias that has a polarity reverse to the toner is applied to the transfer member, then, the electrification bias applied to the electrification device is turned off and a bias that has a polarity identical to the toner is applied to the transfer member.

9. The image forming apparatus according to claim 8, wherein the bias that has the polarity reverse to the toner and is applied to the transfer member after the toner ejection pattern passes, and the bias that has the polarity identical to the toner and is applied to the transfer member after the toner ejection pattern passes are applied for a time or longer that is required for one rotation of the transfer member.

10. The image forming apparatus according to claim 1, wherein a linear speed of the toner carrier during the refresh process is slower than a linear speed in a time an image is formed.

11. The image forming apparatus according to claim 10, further comprising a transfer member that transfers a toner image on the toner carrier that is formed by the development device onto a recording medium, wherein a bias that has a polarity identical to the toner is continuously applied to the transfer member until the toner ejection pattern formed on the image carrier passes the transfer member.

12. The image forming apparatus according to claim 11, further comprising an electrification device that electrifies a surface of the image carrier, wherein after the toner ejection pattern formed on the image carrier passes the transfer member, an electrification bias applied to the electrification device is turned on, and a bias that has a polarity reverse to the toner is applied to the transfer member, then, the electrification bias applied to the electrification device is turned off and a bias that has a polarity identical to the toner is applied to the transfer member.

13. The image forming apparatus according to claim 12, wherein the bias that has the polarity reverse to the toner and is applied to the transfer member after the toner ejection pattern passes, and the bias that has the polarity identical to the toner and is applied to the transfer member after the toner ejection pattern passes are applied for a time or longer that is required for one rotation of the transfer member.

14. The image forming apparatus according to claim 1, further comprising a transfer member that transfers a toner image on the toner carrier that is formed by the development device onto a recording medium, wherein a bias that has a polarity identical to the toner is continuously applied to the transfer member until the toner ejection pattern formed on the image carrier passes the transfer member.

15. The image forming apparatus according to claim 14, further comprising an electrification device that electrifies a surface of the image carrier, wherein after the toner ejection pattern formed on the image carrier passes the transfer member, an electrification bias applied to the electrification device is turned on, and a bias that has a polarity reverse to the toner is applied to the transfer member, then, the electrification bias applied to the electrification device is turned off and a bias that has a polarity identical to the toner is applied to the transfer member.

16. The image forming apparatus according to claim 15, wherein the bias that has the polarity reverse to the toner and is applied to the transfer member after the toner ejection pattern passes, and the bias that has the polarity identical to the toner and is applied to the transfer member after the toner ejection pattern passes are applied for a time or longer that is required for one rotation of the transfer member.

* * * * *